US008276837B2

(12) United States Patent
Becker et al.

(10) Patent No.: US 8,276,837 B2
(45) **Date of Patent: *Oct. 2, 2012**

(54) METHOD AND DEVICES FOR DETACHING A CHARGE STUCK TO THE INNER WALL OF A GRINDING PIPE

(75) Inventors: Norbert Becker, Röttenbach (DE); Stefan Smits, Hemhofen (DE); Kurt Tischler, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/196,387

(22) Filed: Aug. 2, 2011

(65) Prior Publication Data

US 2011/0283504 A1 Nov. 24, 2011

Related U.S. Application Data

(63) Continuation of application No. 10/599,283, filed as application No. PCT/EP2005/051029 on Mar. 8, 2005, now Pat. No. 8,079,536.

(30) Foreign Application Priority Data

Mar. 25, 2004 (DE) ..... 10 2004 015 057

(51) Int. Cl.
*B02C 19/00* (2006.01)

(52) U.S. Cl. ..... 241/30; 241/299

(58) Field of Classification Search ..... 241/30, 241/36

See application file for complete search history.

(56) References Cited

U.S. PATENT DOCUMENTS

| | | | | |
|---|---|---|---|---|
| 2,232,696 | A | 2/1941 | Theodore | 241/14 |
| 4,493,156 | A | 1/1985 | Siegmann | 34/319 |
| 4,496,883 | A | 1/1985 | Eastcott et al. | 318/98 |
| 4,576,572 | A | 3/1986 | Mueller et al. | 432/13 |
| 5,203,359 | A | 4/1993 | Fesmire | 134/61 |
| 5,698,797 | A | 12/1997 | Fontanille et al. | 73/865.9 |
| 7,017,841 | B2 | 3/2006 | Tirschler | 241/30 |
| 8,079,536 | B2 * | 12/2011 | Becker et al. | 241/30 |
| 2003/0052205 | A1 | 3/2003 | Tirschler | 241/32.5 |
| 2006/0113416 | A1 | 6/2006 | Tirschler | 241/299 |
| 2006/0138358 | A1 | 6/2006 | Lof et al. | 250/492.22 |

FOREIGN PATENT DOCUMENTS

| | | |
|---|---|---|
| DE | 3528409 | 2/1987 |
| DE | 19943150 | 3/2001 |

OTHER PUBLICATIONS

International Search Report with English Translation, PCT/EP2005/051029 (6 pages), Jun. 16, 2005.

* cited by examiner

*Primary Examiner* — Mark Rosenbaum
(74) *Attorney, Agent, or Firm* — King & Spalding L.L.P.

(57) ABSTRACT

In a method for detaching a charge (5) which is stuck to the inner wall of a grinding pipe (1), the grinding pipe (1) is rotated in a targeted manner such that the charge (5) that is stuck is removed from the inner wall of the grinding pipe (1) as a result of multiple modification of the rotational speed of the grinding pipe (1) and, optionally, as a result of abrupt braking of the grinding pipe (1). Generally speaking, the material-dependent maximum angle of rotation F of the grinding pipe is not exceeded in order to avoid the charge that is stuck from falling in an uncontrolled manner. The invention supercedes labor-intensive and protracted methods for detaching such charges (5) since the tasks can be carried out by the same motor of the drive device (2) which is used to drive the grinding pipe (1) during the grinding process.

23 Claims, 2 Drawing Sheets

METHOD AND DEVICES FOR DETACHING A CHARGE STUCK TO THE INNER WALL OF A GRINDING PIPE

CROSS-REFERENCE TO RELATED APPLICATIONS

This application is a continuation of U.S. application Ser. No. 10/599,283 filed Sep. 25, 2006, now U.S. Pat. No. 8,079,536, which is a U.S. National Stage Application of International Application No. PCT/EP2005/051029 filed Mar. 8, 2005, which designates the United States of America, and claims priority to German application number 10 2004 015 057.5 filed Mar. 25, 2004. The contents of which are hereby incorporated by reference in their entirety.

TECHNICAL FIELD

The invention relates to a method for detaching a firmly adhering charge from the inner wall of a grinding pipe, in particular a tube mill, a control device for the drive device of a grinding pipe and also a drive device of a grinding pipe.

BACKGROUND

Tube mills are used mainly for grinding materials such as ore. It is not unusual for the operation of a tube mill to be interrupted and the tube mill to be out of action for a relatively long period of time. This occurs for maintenance reasons, for example. During the standstill of the tube mill, the material present in the grinding pipe of the tube mill can consolidate and adhere firmly to the inner wall of the grinding pipe. Such firmly adhering, consolidated material stuck to the inner wall of the grinding pipe is referred to as frozen charge. When the tube mill is brought back into operation after a relatively long standstill, there is a risk that the frozen charge will become detached from the grinding pipe at great height, fall down and cause considerable damage to the tube mill when it then strikes the grinding pipe.

Arrangements therefore exist which detect the presence of frozen charges and, when the presence of a frozen charge is detected, switch the tube mill off. Such an arrangement is described in German laid-open print DE 35 28 409 A1, for example.

If a frozen charge is detected and the tube mill is switched off, the frozen charge must then be removed, which is laborious. This is done, for example, by softening, by water being sprayed onto the frozen charge and/or using compressed-air hammers. Removal of a frozen charge requires an extremely great, for the most part manual, expenditure of work and is very time-intensive.

SUMMARY

It is an object of the invention to make the removal of a frozen charge possible in a simple efficient way.

According to an embodiment, the drive device of the grinding pipe is used for loosening and detaching the frozen charge. By controlling or regulating the drive device of the grinding pipe for targeted detachment of the frozen charge, the grinding pipe is rotated in an angular range in which falling material does not cause damage to the grinding pipe or other components of the tube mill. Time-consuming manual actions can thus be dispensed with in most cases.

Angle of rotation and speed of rotation of the grinding pipe are advantageously varied by the drive device. By targeted variation of the rotary movement, that is variation of acceleration and direction of rotation of the grinding pipe, the frozen charge is loosened and detached from the inner wall of the grinding pipe without causing damage to the tube mill.

A maximum value of the angle of rotation smaller than 180° is advantageously not exceeded. It is not possible for the grinding pipe to perform a complete revolution.

A maximum value of the angle of rotation smaller than or equal to 90° is advantageously not exceeded. If the value of the angle of rotation is not greater than 90°, falling of the frozen charge is considerably less likely than in the case of larger values of the angle of rotation.

The maximum value of the angle of rotation is advantageously dependent on the material nature of the frozen charge. The maximum value of the angle of rotation up to which falling of the frozen charge with great probability has no damaging effects on the tube mill or is even excluded often lies appreciably below 90°. In some cases, the maximum value of the angle of rotation will even have to be limited to relatively close to 0°. In order to make targeted detachment of the frozen charge possible on the one hand in as short a time as possible and on the other hand with the least possible risk, the maximum value of the angle of rotation is determined as a function of the material nature of the frozen charge.

The angle of rotation is advantageously set to oscillate about at least one predetermined angle of rotation. The angle of rotation is advantageously set to oscillate about a number of predetermined angles of rotation with the same sign one after another. The angle of rotation is advantageously set to oscillate about a number of predetermined angles of rotation with different signs one after another.

The reciprocating movement of the grinding pipe according to the above embodiments of the invention causes the frozen charge to be detached relatively quickly from the inner wall of the grinding pipe, falling causing damage being avoided at the same time.

The grinding pipe is advantageously braked abruptly at least once at a predetermined angle of rotation. The sudden reduction in the speed of rotation of the grinding pipe causes strong detaching forces caused by inertia to act on the frozen charge. After the grinding pipe has been braked once or a number of times, in particular during a downwardly directed movement phase of the frozen charge brought about by the rotation of the grinding pipe, the frozen charge and/or parts of the frozen charge will be detached from the grinding pipe and ideally continue to move downwards by sliding.

The grinding pipe is advantageously braked abruptly to a standstill. Sudden, discontinuous variation of the speed of the grinding pipe to zero causes especially strong detaching forces caused by the inertia to act on the frozen charge.

The same motor is advantageously used for detaching the frozen charge as for rotating the grinding pipe during grinding operation. By virtue of the fact that the same motor is used for driving the grinding pipe both during grinding operation and for detaching the frozen charge, involved resetting and change-over operations are not necessary.

The frozen charge is advantageously wetted. Detaching the frozen charge is made easier by spraying with water, for example. The consistency and the adhesiveness of the frozen charge are influenced expediently by wetting.

The control device according to the invention advantageously has means for defining an operating cycle for the grinding pipe. In this way, targeted detachment of the frozen charge is essentially made possible largely automatically and without damage to the grinding pipe.

The control device advantageously has a field-oriented regulating arrangement. Control or regulation of the drive device for targeted detachment of the frozen charge is thus simplified considerably.

The drive device according to the invention advantageously has a motor which drives the grinding pipe both during grinding operation and for detaching the frozen charge. The construction of the drive device and the tube mill as a whole thus becomes simpler, more robust, more compact and more cost-effective.

The motor of the drive device is advantageously coupled to a converter. The motor is advantageously a ring motor. The use of a gearless drive designed as a ring motor results in a more robust, lower-maintenance tube mill and the system described for targeted detachment of the frozen charge being easy to implement.

BRIEF DESCRIPTION OF THE DRAWINGS

Further details of the invention are described by way of example below with reference to the drawings, in which.

DETAILED DESCRIPTION

Figure 1:
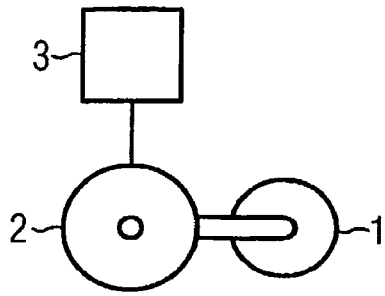
FIG. 1 shows the schematic construction of a tube mill.

FIG. 1 shows the schematic construction of a tube mill as is used for grinding ores, for example. The tube mill has a grinding pipe 1 which is coupled to a drive device 2. Furthermore, a control device 3 which provides control and regulating signals to the drive device 2 is provided. The control device 3 can also receive and process signals, for example measurement signals, from the drive device 2 or other components of the tube mill. The grinding pipe 1 is preferably of drum-shaped design. The tube mill has bearing devices for the grinding pipe 1, which are not illustrated in greater detail in the drawing.

The drive device 2 of the tube mill has at least one motor, which is designed as a ring motor, for example. The motor is coupled to a converter (not illustrated in greater detail). The embodiment of the motor as a ring motor makes gearless drive of the grinding pipe 1 and consequently particularly robust operation of the tube mill possible.

The drive device 2 is preferably designed as a field-oriented polyphase machine, a field-oriented regulating arrangement being provided in the control device 3. The field-oriented regulating arrangement is designed as a flux counter, for example.

The tube mill normally functions in grinding operation, that is the drive device 2 drives the grinding pipe in such a way that the material present in the grinding pipe 1 is comminuted by the movement of the grinding pipe 1. The material is loose during grinding operation and does not adhere to the grinding pipe 1. If grinding operation is interrupted for a relatively long time, the problem of the occurrence of frozen charges can arise, as described in the introduction.

Figure 2:
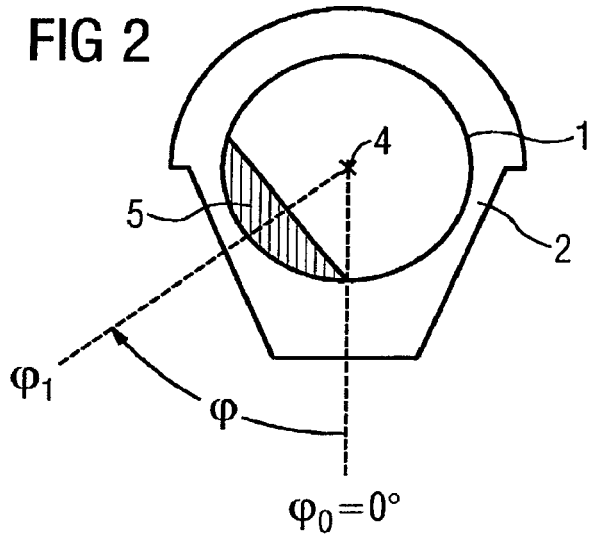
FIG. 2 and FIG. 3 show a section through the grinding pipe of a tube mill.

FIG. 2 shows a section through the grinding pipe 1 of a tube mill, the grinding pipe 1 being surrounded by a drive device 2, here a schematically illustrated ring motor with a bearing device. The grinding pipe 1 is mounted rotatably about the axis of rotation 4 by means of the drive device 2. The hatched region in the interior of the grinding pipe 1 represents a frozen charge 5 schematically. The frozen charge 5 is formed by material which has consolidated, baked, frozen, adhered, compacted, pressed or sintered together practically to form a rigid body during a relatively long standstill of the tube mill. In FIG. 2, the center of gravity of the frozen charge 5 has been deflected in relation to a starting position indicated by $\phi_0=0°$ by the angle of rotation $\phi$ to an angle of rotation indicated by $\phi_1$.

Figure 3:
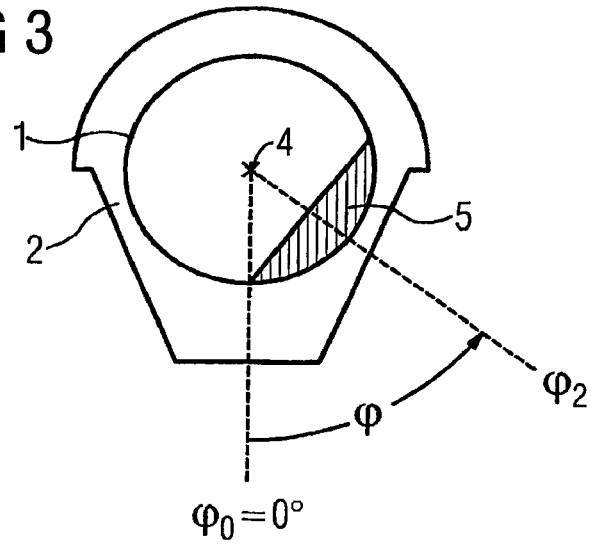

FIG. 3 shows a frozen charge 5 of which the center of gravity has been deflected by the angle of rotation indicated by $\phi_2$. The direction of rotation illustrated in FIG. 3 is opposite to the direction of rotation from FIG. 2.

Deflections in a positive angle of rotation range $\phi_0<\phi<=180°$ and deflections in a negative angle of rotation range $-180°<\phi<\phi_0$ are considered below. Accordingly, $\phi_1$ in FIG. 2 is a positive angle of rotation $\phi$, and $\phi_2$ in FIG. 3 is a negative angle of rotation $\phi$.

The control device 3 shown in FIG. 1 of the drive device 2 of the tube mill is, as described in the introduction, preferably designed in such a way that frozen charges 5 are detected at such an early stage that their falling is avoided by stopping the tube mill. Frozen charges can also be discovered visually, for example by an operator of the tube mill.

If a frozen charge 5 is discovered, the frozen charge 5 is detached according to the invention, before grinding operation is restarted, by the drive device 2 of the grinding pipe being controlled in such a way that the frozen charge is detached in a targeted manner by varying the angle of rotation $\phi$ and the speed of rotation of the grinding pipe 1. In this connection, the same motor is preferably used as also drives the grinding pipe 1 during grinding operation.

When the frozen charge is being detached, the control device 3 ensures that the value of the angle of rotation $\phi$ does not exceed a given maximum value. This prevents the frozen charge 5 falling from too great a height and causing damage to the tube mill. The maximum value of the angle of rotation $\phi$ lies in the range $0°<|\phi|<180°$ and is advantageously determined as a function of the composition and the nature of the material of the frozen charge 5. The maximum value of the angle of rotation $\phi$ can also be defined in the range $0°<|\phi|<90°$.

Figure 4:
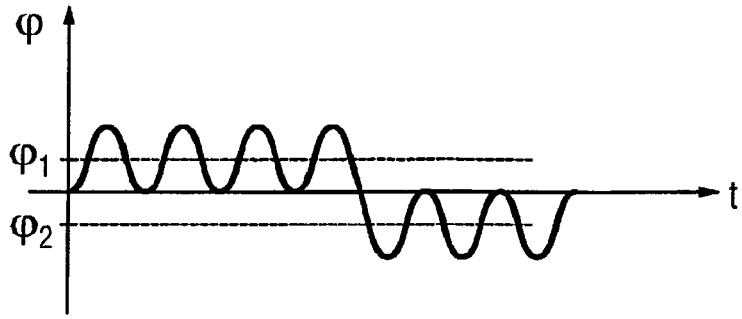
FIG. 4 to FIG. 6 show possible rotary movements of the grinding pipe for targeted detachment of a frozen charge.
Figure 5:
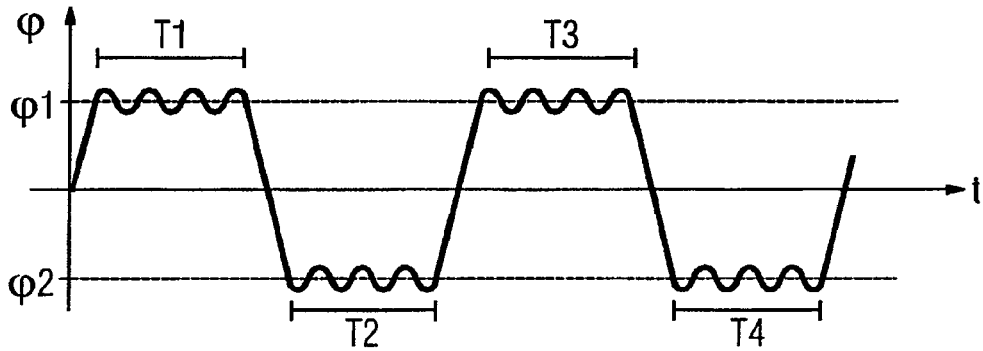

FIG. 4 and FIG. 5 show schematically the deflection of the grinding pipe 1 by the angle of rotation $\phi$ for targeted detachment of a frozen charge plotted over time t. In order to detach the frozen charge 5 from the inner wall of the grinding pipe 1, the grinding pipe 1 is deflected in a targeted manner from a starting position and then oscillates sinusoidally about the angles of rotation $\phi_1$ and $\phi_2$. In the example shown, the starting position is at $\phi_0=0°$ but can also be defined differently.

In FIG. 5, a number of time periods $T_1$ to $T_4$ are indicated. In each of these time periods $T_1$ to $T_4$, the grinding pipe oscillates about a given angle of rotation $\phi_1$ or $\phi_2$. Differently from illustrated by way of example in FIGS. 4 and 5, the amplitude of the oscillation of the angle of rotation $\phi$ about the angle of rotation $\phi_1$ or $\phi_2$ can also vary or be varied. In this connection, the amplitude can be variable within the time periods $T_1$ to $T_4$ and/or in comparison of the time periods $T_1$ to $T_4$ with one another.

It is possible for the grinding pipe 1 to oscillate about one or more positive angles of rotation $\phi_1$. It is also possible for the grinding pipe 1 to oscillate about one or more negative angles of rotation $\phi_2$. The grinding pipe 1 can also be set to oscillate about one or more positive and about one or more negative angles of rotation $\phi_1$ and $\phi_2$.

The control device 3 shown in FIG. 1 for the drive device 2 preferably has means for defining an operating cycle for the grinding pipe 1 in order to control or regulate the movement of the grinding pipe 1 as described above.

The detachment of the frozen charge 5 can be supported by supplying water. If the frozen charge 5 is wetted, it is detached more easily from the inner wall of the grinding pipe 1.

Figure 6:
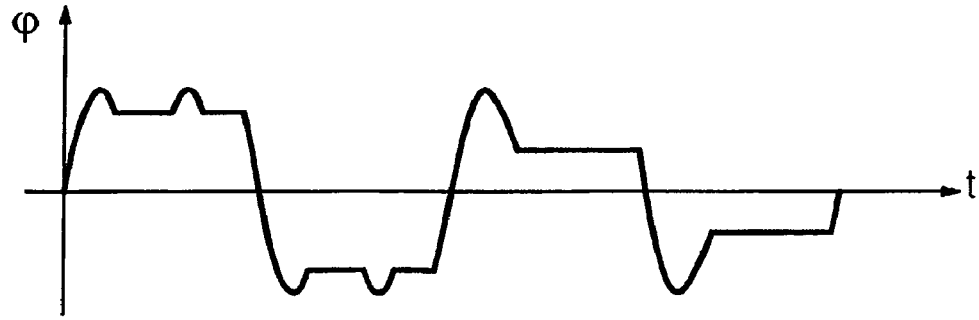

FIG. 6 shows schematically how the grinding pipe 1 is first set in motion and then braked abruptly from the movement several times. As shown in the figure, the braking can take place in such a way that the grinding pipe 1 comes to a standstill for a limited time, or also in such a way that it abruptly slows down its speed of rotation considerably. A change in direction of rotation can also take place. During abrupt braking of the grinding pipe 1, the inertia of the frozen charge 5 has a detaching effect on it.

The basic idea of the invention can be summarized essentially as follows: The invention relates to a method for detaching a frozen charge 5 from the inner wall of a grinding pipe 1, the drive device 2 of the grinding pipe 1 being controlled by a control device 3 for targeted detachment of the frozen charge 5. In this connection, the grinding pipe 1 is rotated in a targeted manner in such a way that the frozen charge 5 is detached from the inner wall of the grinding pipe 1 by repeated variation of the speed of rotation of the grinding pipe 1 and if appropriate by abrupt braking of the grinding pipe 1. In this connection, an as a rule material-dependently determined maximum angle of rotation $\phi$ of the grinding pipe 1 is not exceeded, in order to avoid uncontrolled falling of the frozen charge 5. The invention renders labor-intensive and time-consuming methods for detaching the frozen charge 5 unnecessary, as it can be detached by the same motor of the drive device 2 as is also used during grinding operation for driving the grinding pipe 1.

The invention also relates to a drive device 2 for a grinding pipe 1 and a control device 3 for such a drive device 2.

The invention claimed is:

1. A method for detaching a frozen charge from the inner wall of a grinding pipe, comprising:

determining a maximum value of the angle of rotation with respect to a reference angle based on the material nature of the frozen charge;

controlling a drive device of the grinding pipe for targeted detachment of the frozen charge, including:

varying an angle of rotation and a speed of rotation of the grinding pipe, such that the angle of rotation of the grinding pipe does not exceed the determined maximum value of the angle of rotation with respect to the reference angle, and abruptly braking the grinding pipe at least once at a predetermined angle of rotation.

2. The method according to claim 1, wherein a predetermined maximum value of the angle of rotation smaller than 180° is not exceeded.

3. The method according to claim 1, wherein a predetermined maximum value of the angle of rotation smaller than or equal to 90° is not exceeded.

4. The method according to claim 1, comprising abruptly braking the grinding pipe multiple times.

5. The method according to claim 1, comprising abruptly braking the grinding pipe during a downward movement of the frozen charge caused by a rotation of the grinding pipe.

6. The method according to claim 1, comprising abruptly braking the grinding pipe to a standstill.

7. The method according to claim 1, wherein the same motor is used for detaching the frozen charge as for rotating the grinding pipe during grinding operation.

8. The method according to claim 1, wherein the frozen charge is wetted.

9. A method for detaching a frozen charge from the inner wall of a grinding pipe mounted rotatably about a horizontal axis of rotation, the frozen charge being formed during a standstill of the grinding pipe with the grinding pipe positioned at a zero angle of rotation and the frozen charge having a center of gravity positioned below the horizontal axis of rotation, comprising the steps of:

controlling a drive device of the grinding pipe for targeted detachment of the frozen charge from the inner wall of the grinding pipe;

varying an angle of rotation and a speed of rotation of the grinding pipe by the drive device; and controlling the angle of rotation to oscillate about at least one predetermined non-zero angle of rotation.

10. The method according to claim 9, wherein a maximum value of the angle of rotation smaller than 180° is not exceeded.

11. The method according to claim 9, wherein that a maximum value of the angle of rotation smaller than or equal to 90° is not exceeded.

12. The method according to claim 9, further comprising:

determining a maximum value of the angle of rotation based on the material nature of the frozen charge; and controlling the drive device such that the angle of rotation of the grinding pipe does not exceed the determined maximum value of the angle of rotation.

13. The method according to claim 9, wherein the angle of rotation is set to oscillate about a number of different predetermined angles of rotation with the same arithmetic sign one after another.

14. The method according to claim 9, wherein the angle of rotation is set to oscillate about a number of predetermined angles of rotation with different arithmetic signs one after another.

15. The method according to claim 9, wherein the grinding pipe is braked abruptly at least once at a predetermined angle of rotation.

16. The method according to claim 15, wherein the grinding pipe is braked abruptly to a standstill.

17. The method according to claim 9, wherein the same motor is used for detaching the frozen charge as for rotating the grinding pipe during grinding operation.

18. The method according to claim 9, wherein the frozen charge is wetted.

19. A drive device of a grinding pipe comprising:

a controller that controls the drive device for identification and detachment of a frozen charge from an inner wall of the grinding pipe, the controller including instructions for:

initiating a rotation of the grinding pipe;

during the rotation of the grinding pipe, automatically detecting the presence of a frozen charge on the inner wall of the grinding pipe;

in response to detecting the frozen charge:

automatically stopping the rotation of the grinding pipe to prevent the frozen charge from detaching and falling from the inner wall; and performing a frozen charge detachment process including:

controlling an angle of rotation and speed of rotation of the grinding pipe;

varying the angle of rotation and the speed of rotation of the grinding pipe; and controlling the angle of rotation to oscillate about at least one predetermined angle of rotation to cause the frozen charge to detach from the inner wall of the grinding pipe.

20. The drive device according to claim 19, comprising means for defining an operating cycle for the grinding pipe.

21. The drive device according to claim 19, comprising a field-oriented regulating arrangement.

22. The drive device according to claim 19, comprising a motor which drives the grinding pipe both during grinding operation and for detaching the frozen charge.

23. A method for detaching a frozen charge from the inner wall of a grinding pipe, comprising:

controlling a motor of the grinding pipe to perform a grinding operation; and controlling the motor of the grinding pipe for targeted detachment of the frozen charge, including:

varying an angle of rotation and a speed of rotation of the grinding pipe, and abruptly braking the grinding pipe at least once at a predetermined angle of rotation;

such that the same motor is used for the grinding operation and for the detachment of the frozen charge.

* * * * *